US005774761A

United States Patent [19]

Rai

[11] Patent Number: 5,774,761

[45] Date of Patent: Jun. 30, 1998

[54] MACHINE SET UP PROCEDURE USING MULTIVARIATE MODELING AND MULTIOBJECTIVE OPTIMIZATION

[75] Inventor: Sudhendu Rai, Penfield, N.Y.

[73] Assignee: Xerox Corporation, Stamford, Conn.

[21] Appl. No.: 950,086

[22] Filed: Oct. 14, 1997

[51] Int. Cl.[6] ..... G03G 15/00

[52] U.S. Cl. ..... 399/46; 399/38

[58] Field of Search ..... 399/31, 38, 42, 399/46, 47, 48, 49, 72; 395/101, 109

[56] References Cited

U.S. PATENT DOCUMENTS

| | | | |
|---|---|---|---|
| 4,647,184 | 3/1987 | Russell et al. | 399/48 |
| 5,229,815 | 7/1993 | Sulenski . | |
| 5,243,383 | 9/1993 | Parisi . | |
| 5,262,833 | 11/1993 | Fukushima et al. | 399/42 |
| 5,271,096 | 12/1993 | Cook | 395/131 |
| 5,282,053 | 1/1994 | Robideau | 358/406 |
| 5,400,120 | 3/1995 | Narazaki et al. | 399/46 X |
| 5,666,590 | 9/1997 | Folkins | 399/49 |
| 5,673,106 | 9/1997 | Thompson . | |
| 5,708,916 | 1/1998 | Mestha | 399/49 |
| 5,717,978 | 2/1998 | Mestha | 399/46 |

*Primary Examiner*—Sandra L. Brase
*Attorney, Agent, or Firm*—Ronald F. Chapuran

[57] ABSTRACT

A method of setting up an electrostatographic printing machine having image quality attributes and parameters that control the attributes using multivariate modeling and multiobjective optimization. The method includes providing a discrete number of parameter settings and printing test patterns based upon the parameter settings. The test patterns are scanned to produce a set of image quality values. Using a multivariate adaptive regression splines technique, a model of the printing machine image quality is provided in response to the parameter settings and the image quality values. Optimum parameter settings for the printing machine are then determined from the discrete number of parameter settings to produce consistent image quality.

19 Claims, 2 Drawing Sheets

Figure 1:
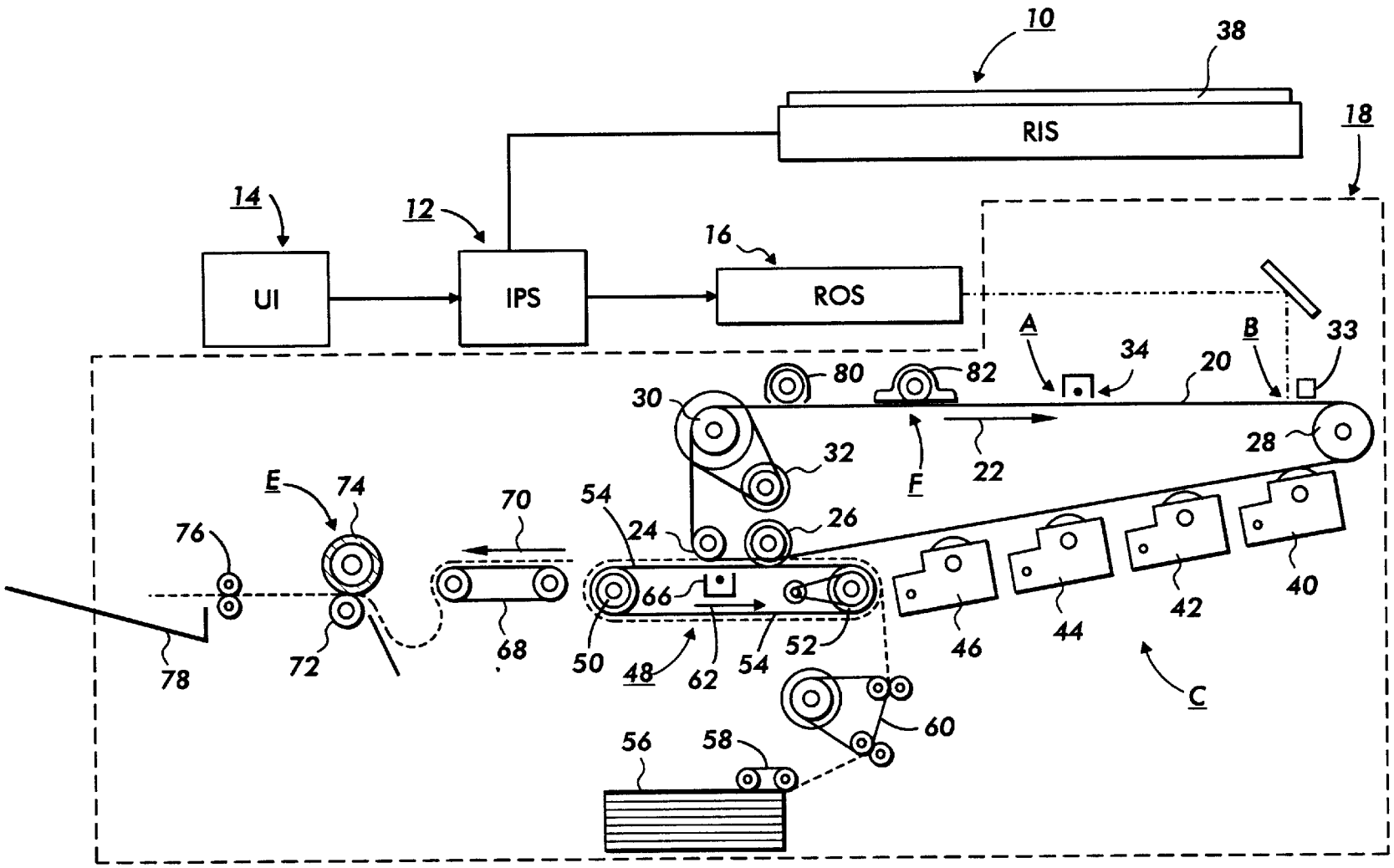

MACHINE SET UP PROCEDURE USING MULTIVARIATE MODELING AND MULTIOBJECTIVE OPTIMIZATION

This invention relates generally to an electrostatographic printing machine and, more particularly, concerns an automatic machine set up process using multivariate modeling and multiobjective optimization.

The basic reprographic process used in an electrostatographic printing machine generally involves an initial step of charging a photoconductive member to a substantially uniform potential. The charged surface of the photoconductive member is thereafter exposed to a light image of an original document to selectively dissipate the charge thereon in selected areas irradiated by the light image. This procedure records an electrostatic latent image on the photoconductive member corresponding to the informational areas contained within the original document being reproduced. The latent image is then developed by bringing a developer material including toner particles adhering triboelectrically to carrier granules into contact with the latent image. The toner particles are attracted away from the carrier granules to the latent image, forming a toner image on the photoconductive member which is subsequently transferred to a copy sheet. The copy sheet having the toner image thereon is then advanced to a fusing station for permanently affixing the toner image to the copy sheet in image configuration.

In electrostatographic machines using a drum-type or an endless belt-type photoconductive member, the photosensitive surface thereof can contain more than one image at one time as it moves through various processing stations. The portions of the photosensitive surface containing the projected images, so-called "image areas", are usually separated by a segment of the photosensitive surface called the inter-document space. After charging the photosensitive surface to a suitable charge level, the inter-document space segment of the photosensitive surface is generally discharged by a suitable lamp to avoid attracting toner particles at the development stations. Various areas on the photosensitive surface, therefore, will be charged to different voltage levels. For example, there will be the high voltage level of the initial charge on the photosensitive surface, a selectively discharged image area of the photosensitive surface, and a fully discharged portion of the photosensitive surface between the image areas.

The approach utilized for multicolor electrostatographic printing is substantially identical to the process described above. However, rather than forming a single latent image on the photoconductive surface in order to reproduce an original document, as in the case of black and white printing, multiple latent images corresponding to color separations are sequentially recorded on the photoconductive surface. Each single color electrostatic latent image is developed with toner of a color complimentary thereto and the process is repeated for differently colored images with the respective toner of complimentary color. Thereafter, each single color toner image can be transferred to the copy sheet in superimposed registration with the prior toner image, creating a multi-layered toner image on the copy sheet. Finally, this multi-layered toner image is permanently affixed to the copy sheet in substantially conventional manner to form a finished color copy.

As described, the surface of the photoconductive member must be charged by a suitable device prior to exposing the photoconductive member to a light image. This operation is typically performed by a corona charging device. One type of corona charging device comprises a current carrying electrode enclosed by a shield on three sides and a wire grid or control screen positioned thereover, and spaced apart from the open side of the shield. Biasing potentials are applied to both the electrode and the wire grid to create electrostatic fields between the charged electrode and the shield, between the charged electrode and the wire grid, and between the charged electrode and the (grounded) photoconductive member. These fields repel electrons from the electrode and the shield resulting in an electrical charge at the surface of the photoconductive member roughly equivalent to the grid voltage. The wire grid is located between the electrode and the photoconductive member for controlling the charge strength and charge uniformity on the photoconductive member as caused by the aforementioned fields.

Control of the field strength and the uniformity of the charge on the photoconductive member is very important because consistently high quality reproductions are best produced when a uniform charge having a predetermined magnitude is obtained on the photoconductive member. If the photoconductive member is not charged to a sufficient level, the electrostatic latent image obtained upon exposure will be relatively weak and the resulting deposition of development material will be correspondingly decreased. As a result, the copy produced by an undercharged photoconductor will be faded. If, however, the photoconductive member is overcharged, too much developer material will be deposited on the photoconductive member. The copy produced by an overcharged photoconductor will have a gray or dark background instead of the white background of the copy paper. In addition, areas intended to be gray will be black and tone reproduction will be poor. Moreover, if the photoconductive member is excessively overcharged, the photoconductive member can become permanently damaged.

A useful tool for measuring voltage levels on the photosensitive surface is an electrostatic voltmeter (ESV) or electrometer. The electrometer is generally rigidly secured to the reproduction machine adjacent the moving photosensitive surface and measures the voltage level of the photosensitive surface as it traverses an ESV probe. The surface voltage is a measure of the density of the charge on the photoreceptor, which is related to the quality of the print output. In order to achieve high quality printing, the surface potential on the photoreceptor at the developing zone should be within a precise range.

In a typical xerographic charging system, the amount of voltage obtained at the point of electrostatic voltage measurement of the photoconductive member, namely at the ESV, is less than the amount of voltage applied at the wire grid of the point of charge application. In addition, the amount of voltage applied to the wire grid of the corona generator required to obtain a desired constant voltage on the photoconductive member must be increased or decreased according to various factors which affect the photoconductive member. Such factors include the rest time of the photoconductive member between printing, the voltage applied to the corona generator for the previous printing job, the copy length of the previous printing job, machine to machine variance, the age of the photoconductive member and changes in the environment.

One way of monitoring and controlling the surface potential in the development zone is to locate a voltmeter directly in the developing zone and then to alter the charging conditions until the desired surface potential is achieved in the development zone. However, the accuracy of voltmeter measurements can be affected by the developing materials (such as toner particles) such that the accuracy of the measurement of the surface potential is decreased. In addition, in color printing there can be a plurality of developing areas within the developing zone corresponding to each color to be applied to a corresponding latent image. Because it is desirable to know surface potential on the photoreceptor at each of the color developing areas in the developing zone, it would be necessary to locate a voltmeter at each color area within the developing zone. Cost and space limitations make such an arrangement undesirable.

In a typical charge control system, the point of charge application and the point of charge measurement is different. The zone between these two devices loses the immediate benefit of charge control decisions based on measured voltage error since this zone is downstream from the charging device. This zone may be as great as a belt revolution or more due to charge averaging schemes. This problem is especially evident in aged photoreceptors because their cycle-to-cycle charging characteristics are more difficult to predict. Charge control delays can result in improper charging, poor copy quality and often leads to early photoreceptor replacement. Thus, there is a need to anticipate the behavior of a subsequent copy cycle and to compensate for predicted behavior beforehand.

Various systems have been designed and implemented for controlling charging processes within a printing machine. For example, U.S. Pat. No. 5,243,383 discloses a charge control system that measures first and second surface voltage potentials to determine a dark decay rate model representative of voltage decay with respect to time. The dark decay rate model is used to determine the voltage at any point on the imaging surface corresponding to a given charge voltage. This information provides a predictive model to determine the charge voltage required to produce a target surface voltage potential at a selected point on the imaging surface.

U.S. Pat. No. 5,243,383 discloses a charge control system that uses three parameters to determine a substrate charging voltage, a development station bias voltage, and a laser power for discharging the substrate. The parameters are various difference and ratio voltages.

The ultimate goal of the digital printing system is to deliver outstanding print quality in both black and color output independent of media. Due to variabilities in marking process and material properties, it is likely that the print quality is prone to drift with time. This simply means that multiple copies of the same image from the same printer do not look consistent. To ensure consistency, in some printers, some of the internal process parameters are measured by creating predefined images in interdocument zones to adjust the actuator values. Sometimes on-line densitometers are used to measure calorimetric values in color printers. Electrostatic Voltmeters and Optical sensors are often used for printers based on xerographic print engines. All these sensors, although giving some information about the state of the internal process, fail to give full information about the quality of the real image that is printed on a paper. Most systems enable some calibration based on the output (printed) image. These processes are usually lengthy and require considerable operator intervention.

Typical prior art calibration systems include U.S. Pat. No. 5,282,053 disclosing a calibration strip of patches of various density levels for scanning and storing signals in a pixel threshold table for comparing to signals of scanned documents. U.S. Pat. No. 5,229,815 discloses a technique for automatically suspending and restarting an image quality adjustment process. U.S. Pat. No. 5,271,096 discloses a technique of storing and printing out a calibration image as a resultant calibration picture. The resultant calibration picture is then input to the system again to create a resultant calibration image. A comparison is made between the original calibration picture and the resultant calibration picture to yield calibration data. The calibration data is then used in a correction stage to correct a picture input to the system to provide an anti distorted output picture substantially identical to the input picture.

A difficulty with the prior art is the relative inability to automatically adjust and fine tune the xerographic system in response to significant changes in parameters or set points due to system drift or operator selected quality levels. The set up of a machine often involves several steps including manual intervention by a technician in which various nominal operating setpoints of the machine are determined.

It is an object of the present invention, therefore, to be able to model the system to be able to give full information about the quality of the real image printed on paper without considerable effort and operator intervention. It is another object of the present invention to provide a system that provides desired solid area and halftone patches for all colors and provides the desired highlights and color balance. Another object of the present invention is to provide a machine setup that tunes various quality attributes and the set of parameters that control the attributes in an interactive manner. Further advantages of the present invention will become apparent as the following description proceeds, and the features characterizing the invention will be pointed out with particularity in the claims annexed to and forming a part of this specification.

SUMMARY OF THE INVENTION

The present invention relates to a method of setting up an electrostatographic printing machine having image quality attributes and parameters that control the attributes using multivariate modeling and multiobjective optimization. The method includes providing a discrete number of parameter settings and printing test patterns based upon the parameter settings. The test patterns are scanned to produce a set of image quality values. Using a multivariate adaptive regression splines technique, a model of the printing machine image quality is provided in response to the parameter settings and the image quality values. Optimum parameter settings for the printing machine are then determined from the discrete number of parameter settings to produce consistent image quality.

Figure 2:
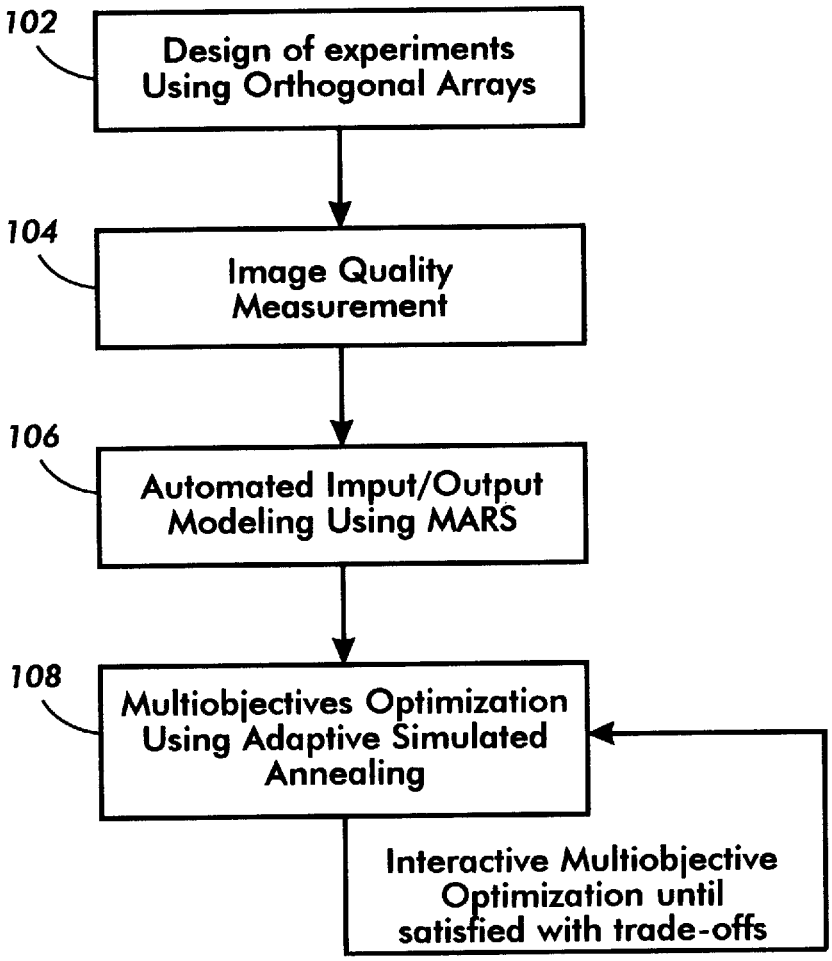

Other features of the present invention will become apparent as the following description proceeds and upon reference to the drawings, in which:

FIG. 1 is a schematic elevational view of an exemplary multicolor electrophotographic printing machine which can be utilized in the practice of the present invention; and FIG. 2 is a flow chart of multivariate modeling and multiobjective optimization in accordance with the present invention.

A schematic elevational view showing an exemplary electrophotographic printing machine incorporating the features of the present invention therein is shown in FIG. 1. It will become evident from the following discussion that the present invention is equally well-suited for use in a wide variety of printing systems including ionographic printing machines and discharge area development systems, as well as other more general non-printing systems providing multiple or variable outputs such that the invention is not necessarily limited in its application to the particular system shown herein.

To initiate the copying process, a multicolor original document 38 is positioned on a raster input scanner (RIS), indicated generally by the reference numeral 10. The RIS 10 contains document illumination lamps, optics, a mechanical scanning drive, and a charge coupled device (CCD array) for capturing the entire image from original document 38. The RIS 10 converts the image to a series of raster scan lines and measures a set of primary color densities, i.e. red, green and blue densities, at each point of the original document. This information is transmitted as an electrical signal to an image processing system (IPS), indicated generally by the reference numeral 12, which converts the set of red, green and blue density signals to a set of calorimetric coordinates. The IPS contains control electronics for preparing and managing the image data flow to a raster output scanner (ROS), indicated generally by the reference numeral 16.

A user interface (UI), indicated generally by the reference numeral 14, is provided for communicating with IPS 12. UI 14 enables an operator to control the various operator adjustable functions whereby the operator actuates the appropriate input keys of UI 14 to adjust the parameters of the copy. UI 14 may be a touch screen, or any other suitable device for providing an operator interface with the system. The output signal from UI 14 is transmitted to IPS 12 which then transmits signals corresponding to the desired image to ROS 16.

ROS 16 includes a laser with rotating polygon mirror blocks. The ROS 16 illuminates, via mirror 37, a charged portion of a photoconductive belt 20 of a printer or marking engine, indicated generally by the reference numeral 18. Preferably, a multi-facet polygon mirror is used to illuminate the photoreceptor belt 20 at a rate of about 400 pixels per inch. The ROS 16 exposes the photoconductive belt 20 to record a set of three subtractive primary latent images thereon corresponding to the signals transmitted from IPS 12. One latent image is to be developed with cyan developer material, another latent image is to be developed with magenta developer material, and the third latent image is to be developed with yellow developer material. These developed images are subsequently transferred to a copy sheet in superimposed registration with one another to form a multicolored image on the copy sheet which is then fused thereto to form a color copy. This process will be discussed in greater detail hereinbelow.

With continued reference to FIG. 1, marking engine 18 is an electrophotographic printing machine comprising photoconductive belt 20 which is entrained about transfer rollers 24 and 26, tensioning roller 28, and drive roller 30. Drive roller 30 is rotated by a motor or other suitable mechanism coupled to the drive roller 30 by suitable means such as a belt drive 32. As roller 30 rotates, it advances photoconductive belt 20 in the direction of arrow 22 to sequentially advance successive portions of the photoconductive belt 20 through the various processing stations disposed about the path of movement thereof.

Photoconductive belt 20 is preferably made from a polychromatic photoconductive material comprising an anti-curl layer, a supporting substrate layer and an electrophotographic imaging single layer or multi-layers. The imaging layer may contain homogeneous, heterogeneous, inorganic or organic compositions. Preferably, finely divided particles of a photoconductive inorganic compound are dispersed in an electrically insulating organic resin binder. Typical photoconductive particles include metal free phthalocyanine, such as copper phthalocyanine, quinacridones, 2,4-diaminotriazines and polynuclear aromatic quinines. Typical organic resinous binders include polycarbonates, acrylate polymers, vinyl polymers, cellulose polymers, polyesters, polysiloxanes, polyamides, polyurethanes, epoxies, and the like.

Initially, a portion of photoconductive belt 20 passes through a charging station, indicated generally by the reference letter A. At charging station A, a corona generating device 34 or other charging device generates a charge voltage to charge photoconductive belt 20 to a relatively high, substantially uniform voltage potential. The corona generator 34 comprises a corona generating electrode, a shield partially enclosing the electrode, and a grid disposed between the belt 20 and the unenclosed portion of the electrode. The electrode charges the photoconductive surface of the belt 20 via corona discharge. The voltage potential applied to the photoconductive surface of the belt 20 is varied by controlling the voltage potential of the wire grid.

Next, the charged photoconductive surface is rotated to an exposure station, indicated generally by the reference letter B. Exposure station B receives a modulated light beam corresponding to information derived by RIS 10 having a multicolored original document 38 positioned thereat. The modulated light beam impinges on the surface of photoconductive belt 20, selectively illuminating the charged surface of photoconductive belt 20 to form an electrostatic latent image thereon. The photoconductive belt 20 is exposed three times to record three latent images representing each color.

After the electrostatic latent images have been recorded on photoconductive belt 20, the belt is advanced toward a development station, indicated generally by the reference letter C. However, before reaching the development station C, the photoconductive belt 20 passes subjacent to a voltage monitor, preferably an electrostatic voltmeter 33, for measurement of the voltage potential at the surface of the photoconductive belt 20. The electrostatic voltmeter 33 can be any suitable type known in the art wherein the charge on the photoconductive surface of the belt 20 is sensed, such as disclosed in U.S. Pat. Nos. 3,870,968; 4,205,257; or 4,853,639, the contents of which are incorporated by reference herein.

A typical electrostatic voltmeter is controlled by a switching arrangement which provides the measuring condition in which charge is induced on a probe electrode corresponding to the sensed voltage level of the belt 20. The induced charge is proportional to the sum of the internal capacitance of the probe and its associated circuitry, relative to the probe-to-measured surface capacitance. A DC measurement circuit is combined with the electrostatic voltmeter circuit for providing an output which can be read by a conventional test meter or input to a control circuit, as for example, the control circuit of the present invention. The voltage potential measurement of the photoconductive belt 20 is utilized to determine specific parameters for maintaining a predetermined potential on the photoreceptor surface, as will be understood with reference to the specific subject matter of the present invention, explained in detail hereinbelow.

The development station C includes four individual developer units indicated by reference numerals 40, 42, 44 and 46. The developer units are of a type generally referred to in the art as "magnetic brush development units". Typically, a magnetic brush development system employs a magnetizable developer material including magnetic carrier granules having toner particles adhering triboelectrically thereto. The developer material is continually brought through a directional flux field to form a brush of developer material. The developer material is constantly moving so as to continually provide the brush with fresh developer material. Development is achieved by bringing the brush of developer material into contact with the photoconductive surface.

Developer units 40, 42, and 44, respectively, apply toner particles of a specific color corresponding to the compliment of the specific color separated electrostatic latent image recorded on the photoconductive surface. Each of the toner particle colors is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 20, while the green areas will be reduced to a voltage level ineffective for development. The charged areas are then made visible by having developer unit 40 apply green absorbing (magenta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) toner particles. Developer unit 46 contains black toner particles and may be used to develop the electrostatic latent image formed from a black and white original document.

In FIG. 1, developer unit 40 is shown in the operative position with developer units 42, 44 and 46 being in the non-operative position. During development of each electrostatic latent image, only one developer unit is in the operative position, while the remaining developer units are in the non-operative position. Each of the developer units is moved into and out of an operative position. In the operative position, the magnetic brush is positioned substantially adjacent the photoconductive belt, while in the nonoperative position, the magnetic brush is spaced therefrom. Thus, each electrostatic latent image or panel is developed with toner particles of the appropriate color without commingling.

After development, the toner image is moved to a transfer station, indicated generally by the reference letter D. Transfer station D includes a transfer zone, defining the position at which the toner image is transferred to a sheet of support material, which may be a sheet of plain paper or any other suitable support substrate. A sheet transport apparatus, indicated generally by the reference numeral 48, moves the sheet into contact with photoconductive belt 20. Sheet transport 48 has a belt 54 entrained about a pair of substantially cylindrical rollers 50 and 52. A friction retard feeder 58 advances the uppermost sheet from stack 56 onto a pre-transfer transport 60 for advancing a sheet to sheet transport 48 in synchronism with the movement thereof so that the leading edge of the sheet arrives at a preselected position, i.e. a loading zone. The sheet is received by the sheet transport 48 for movement therewith in a recirculating path. As belt 54 of transport 48 moves in the direction of arrow 62, the sheet is moved into contact with the photoconductive belt 20, in synchronism with the toner image developed thereon.

In transfer zone 64, a corona generating device 66 sprays ions onto the backside of the sheet so as to charge the sheet to the proper magnitude and polarity for attracting the toner image from photoconductive belt 20 thereto. The sheet remains secured to the sheet gripper so as to move in a recirculating path for three cycles. In this manner, three different color toner images are transferred to the sheet in superimposed registration with one another. Each of the electrostatic latent images recorded on the photoconductive surface is developed with the appropriately colored toner and transferred, in superimposed registration with one another, to the sheet for forming the multi-color copy of the colored original document. One skilled in the art will appreciate that the sheet may move in a recirculating path for four cycles when undercolor black removal is used.

After the last transfer operation, the sheet transport system directs the sheet to a vacuum conveyor, indicated generally by the reference numeral 68. Vacuum conveyor 68 transports the sheet, in the direction of arrow 70, to a fusing station, indicated generally by the reference letter E, where the transferred toner image is permanently fused to the sheet. The fusing station includes a heated fuser roll 74 and a pressure roll 72. The sheet passes through the nip defined by fuser roll 74 and pressure roll 72. The toner image contacts fuser roll 74 so as to be affixed to the sheet. Thereafter, the sheet is advanced by a pair of rolls 76 to a catch tray 78 for subsequent removal therefrom by the machine operator.

The last processing station in the direction of movement of belt 20, as indicated by arrow 22, is a cleaning station, indicated generally by the reference letter F. A lamp 80 illuminates the surface of photoconductive belt 20 to remove any residual charge remaining thereon. Thereafter, a rotatably mounted fibrous brush 82 is positioned in the cleaning station and maintained in contact with photoconductive belt 20 to remove residual toner particles remaining from the transfer operation prior to the start of the next successive imaging cycle.

In accordance with the present invention, setup of a machine involves several steps in which the different nominal operating setpoints of the machine are determined via a series of steps to produce desired color images on the final substrate. This includes setting up the machine so that the desired solid area and halftone patches are produced for all colors, the desired highlights are obtained and the desired color balance is obtained (to name a few). The machine setup is done for each of these image quality attributes and a set of parameters that control these attributes are "tuned" to obtain the desired response. In many of the present machines, the machine is setup for a set of image quality attributes sequentially. Thus for example, the machine may first be setup to get the right solid area response and halftone patches and once that has been accomplished to satisfaction, the machine is setup to obtain the desired highlights and other image quality attributes.

Whether the machine is setup for each image quality attribute sequentially or a set of image quality attributes one at a time, the general problem can be mathematically represented as follows:

Suppose, that the image quality attributes under consideration in a particular step of the setup process are denoted by a vector $p=\{p_1,p_2, p_n\}$ where $$p \epsilon R^n$$

In other words one is interested in "n" image quality attributes. For example, in a particular step of the setup process, these could be the density of four 70% halftone patches namely, cyan, magenta, yellow and black. In that case, the vector describing the objectives of our optimization process would be a four dimensional vector.

Also suppose that the parameters used to setup the machine are denoted by $x=\{x_1,x_2, \ldots, x_m\}$ where $$x \epsilon R^m$$

In other words, there are "m" parameters that have to be tuned to produce desired image quality attributes p which depends on the parameters x. Also suppose that each of these parameters x, can take on a value between $x_{imin}$ and $x_{imax}$. The goal of the setup process can then be described as follows:

Find the appropriate values of each parameter $x_d$ such that the image quality attributes attain the desired values $p_d$.

The first step in the proposed setup process is to identify the m variables x that affect the n image quality attributes p under consideration. (This is often fixed for a specific machine under consideration). For example, the macrouniformity setup with no inboard/outboard variation in prints may be done using the intensity of the laser for each color. In that case, the variables x denote the laser parameters and the variations in ΔE between the inboard and outboard for different colors denotes the image quality attributes p.

The next step is to identify the range of each variable x between which it can vary. This means that the values $x_{imin}$ and $y_{imax}$ are determined for each of the variables $x_i$.

The third step is to design a set of experiments by varying the variables between their respective ranges. The method of orthogonal arrays is proposed for the design of these experiments. Depending on the number of parameters under consideration and the number of intermediate levels of the variables that are chosen, any one of the orthogonal arrays can be chosen.

The machine is then run at different experimental values as defined by the orthogonal array chosen. Once that is done, the different image quality attributes are measured for each experimental setting.

A functional model describing the relationship between each attribute pi and the variables $x_i$ are determined. The model can be a simple linear regression model between the indices $p_i$ and x or a nonlinear model. Specifically, for nonlinear modeling, the multivariate adaptive regression splines (MARS) is proposed.

Once the relationships between image quality attributes and the parameters x have been obtained, the multiobjective optimization methodology is employed to obtain a Pareto-optimal setpoint $x_d$ that gives a desired set of image quality attributes $p_d$. Any linear gradient based search algorithm can be used or if there is possibility of several local minima, a simulated annealing or genetic algorithm can be employed. Specifically, the adaptive simulated annealing method is proposed for obtaining the Pareto-optimal setpoints. Also, for the setup process, since the desired values of the image quality attributes is often known ($p_d$ in this case), the goal programming method of obtaining Pareto-optimal setpoints is preferred. (Although other methods of obtaining Pareto-optimal setpoints can also be used).

If there is significant conflict in simultaneously obtaining all the desired image quality attributes, then one of the many interactive multiobjective optimization methods can be used for trading off one image quality attribute in a Pareto-optimal fashion with another until a desired Pareto-optimal solution has been obtained.

An example of the approach to performing setups in color machines will be demonstrated for the setup step for a given machine. The goal of this setup is to obtain zero inboard/outboard variation in print quality. The four parameters available for setting up for minimal inboard/outboard variation are laser intensities. Each of these four "knobs" can take on a value between 0–255. For the purpose of exemplification, these parameters $x=\{x_1,x_2,x_3,x_4\}$ were chosen to vary between 0–200. An L9 orthogonal array was used to design the experiments and the color of the third patch from the top of the standard test pattern used in this step was chosen as the desired responses. The goal of this setup process is to obtain the setup values for x so that the L,a,b values of the inboard and outboard patches are the same.

The machine was run at the setpoints given by the L9 orthogonal array where the three levels chosen for each "knob" was 0,100 and 200 and the inboard/outboard L,a,b values were measured. For this experiment this was done by first scanning the image as tiff file using a scanner and then using the IQAF software to obtain the L,a,b values. (Other methods for measuring the L,a,b values can also be used).

A nonlinear MARS model was obtained that captured the dependence of each of the six output measured responses (L,a,b for the inboard and L,a,b for the outboard). Let us assume that the relationships are denoted as L1(x),L2(x),a1(x),a2(x),b1(x) and b2(x). The objective of this step of the setup is to obtain a setup point that minimizes the difference between L1 and L2, a1 and a2, and b1 and b2.

Thus a goal programming approach was used to simultaneously minimize the difference for each of the three objectives using adaptive simulated annealing algorithm. (This algorithm has the capability to search for global minima within the space of the design variables without getting "stuck" at a local minima).

The results of setting up the machine at the Pareto-optimal setpoint show that it is possible to setup the machine to less that 2.0 ΔE inboard variation.

This methodology is fairly generic and can be extended to simultaneously setup a machine for any number of image quality attributes. Although, the approach was exemplified using manual scanning and measurements, I believe that the same set of algorithms can be put inside the machine while designing it so that the process is vastly expedited. If the particular printing process has slowly varying parameters (quasi-static), this algorithm (MARS or linear model with an optimizer to obtain the appropriate setpoints) also provides a method for controlling the quasi-static process.

It is, therefore, apparent that there has been provided in accordance with the present invention, a system model that fully satisfies the aims and advantages hereinbefore set forth. While this invention has been is described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. In an electrostatographic printing machine having operating components with changeable set point parameters, a method setting up the machine using multivariate modeling and multiobjective optimization comprising the steps of:

providing a discrete number of parameter settings and printing test patterns based upon said parameter settings, scanning the test patterns and producing a set of image quality values based upon the parameter settings, responding to the parameter settings and the image quality values and using a multivariate adaptive regression splines technique to provide a model of the printing machine image quality, and determining the optimum parameter settings for the printing machine from the discrete number of parameter settings to produce consistent image quality.

2. The method of claim 1 wherein the step of providing a discrete number of parameter settings and printing test patterns based upon said parameter settings includes the step of using orthogonal arrays.

3. The method of claim 1 wherein the step of determining the optimum parameter settings for the printing machine from the discrete number of parameter settings includes the step of using adaptive simulated annealing.

4. In an electrostatographic printing machine having image quality attributes denoted by a vector $p=\{p_1,p_2, \ldots, p_n\}$ and parameters used to setup the machine denoted by $x=\{x_1,x_2, \ldots, x_m\}$, a method of finding appropriate values of each parameter such that the image quality attributes attain desired values comprising the steps of:

identifying the m variables x that affect the n image quality attributes p under consideration, identifying the range of each variable x between which it can vary, providing a set of experiments by varying the variables x between respective ranges using orthogonal arrays, running the machine at different experimental value setting as defined by the orthogonal arrays and measuring the different image quality for each experimental setting, determining a functional model describing the relationship between each attribute p and the variables x, upon determining the relationships between image quality attributes and the parameters x, using a multiobjective optimization methodology to obtain a Pareto-optimal setpoint that gives a desired set of image quality attributes, and in response to a significant conflict in simultaneously obtaining desired image quality attributes, using an interactive multiobjective optimization technique for trading off one image quality attribute in a Pareto-optimal fashion with another until a desired Pareto-optimal solution has been obtained.

5. The method of claim 4 wherein the vector p is an n dimensional vector.

6. The method of claim 4 wherein the m parameters are tuned to produce desired image quality attributes p depending upon the parameters x and the parameters x vary between maximum and minimum values.

7. The method of claim 4 wherein the step of providing a set of experiments by varying the variables x between respective ranges using orthogonal arrays includes the step of determining the number of parameters under consideration and the number of intermediate levels of the variables that are chosen.

8. The method of claim 4 wherein the step of determining a functional model describing the relationship between each attribute p and the variables x, is a simple linear regression model.

9. The method of claim 4 wherein the step of determining a functional model describing the relationship between each attribute p and the variables x is a non-linear model.

10. The method of claim 4 wherein the step of determining a functional model describing the relationship between each attribute p and the variables x is the multivariate adaptive regression splines (MARS) model.

11. The method of claim 4 wherein the step of using a multiobjective optimization methodology to obtain a Pareto-optimal setpoint that gives a desired set of image quality attributes includes the step of using a goal programming method of obtaining the Pareto-optimal setpoints.

12. The method of claim 4 wherein the step of using a multiobjective optimization methodology to obtain a Pareto-optimal setpoint that gives a desired set of image quality attributes includes the use of a linear gradient based search algorithm.

13. The method of claim 4 wherein the step of using a multiobjective optimization methodology to obtain a Pareto-optimal setpoint that gives a desired set of image quality attributes includes the use of an adaptive simulated annealing algorithm.

14. In an electrostatographic printing machine having image quality attributes and parameters used to setup the machine, a method of finding appropriate values of each parameter such that the image quality attributes attain desired values comprising the steps of:

identifying the variables that affect the image quality attributes under consideration, identifying the range of each variable, varying the variables between ranges using orthogonal arrays, running the machine at different value settings as defined by the orthogonal arrays and measuring the different image quality for each setting, determining a functional model describing the relationship between each attribute and the variables, and using a multiobjective optimization methodology to obtain optimal setpoints giving a desired set of image quality attributes.

15. The method of claim 14 wherein the step of using a multiobjective optimization methodology to obtain optimal setpoints giving a desired set of image quality attributes is in response to determining the relationships between image quality attributes and the variables.

16. The method of claim 14 including the step of determining a significant conflict in simultaneously obtaining desired image quality attributes.

17. The method of claim 16 including the step of using an interactive multiobjective optimization technique for trading off one image quality attribute with another until a desired solution has been obtained.

18. In an electrostatographic printing machine having image quality attributes and parameters used to setup the machine, a method of finding appropriate values of each parameter such that the image quality attributes attain desired values comprising the steps of:

identifying variables that affect the image quality attributes, running the machine at different value settings measuring the different image quality for each setting, determining a functional model describing the relationship between each attribute and the variables, and using a multiobjective optimization methodology, obtaining optimal setpoints giving a desired set of image quality attributes.

19. In an electrostatographic printing machine having image quality attributes and parameters used to setup the machine, a method of finding appropriate values of each parameter such that the image quality attributes attain desired values comprising the steps of:

identifying variables that affect the image quality attributes, running the machine at different value settings measuring the different image quality for each setting, determining a functional model describing the relationship between each attribute and the variables, and obtaining optimal setpoints giving a desired set of image quality attributes.

* * * * *